United States Patent [19]

Cunningham

[11] Patent Number: 4,556,265

[45] Date of Patent: Dec. 3, 1985

[54] RF COAXIAL-STRIP LINE CONNECTOR

[75] Inventor: Thomas J. Cunningham, Philadelphia, Pa.

[73] Assignee: RCA Corporation, Princeton, N.J.

[21] Appl. No.: 278,453

[22] Filed: Jun. 29, 1981

[51] Int. Cl.[4] ..... H01R 17/04

[52] U.S. Cl. ..... 339/17 LC; 339/177 R; 339/252 R

[58] Field of Search ..... 339/252 R, 177 R, 177 E, 339/17 C, 17 LC

[56] References Cited

U.S. PATENT DOCUMENTS

| | | | |
|---|---|---|---|
| 3,255,430 | 6/1966 | Phillips | 339/252 R |
| 3,319,217 | 5/1967 | Phillips | 339/252 R X |
| 3,686,624 | 8/1972 | Napoli et al. | 339/177 R |
| 4,125,308 | 11/1978 | Schilling | 339/17 LC |
| 4,358,180 | 11/1982 | Lincoln | 339/252 R |

OTHER PUBLICATIONS

"Microminiature Connectors the Systems Solution to Interconnect Microminiaturization," *ITT Cannon Catalog MDM-RF.*

*Primary Examiner*—Mark Rosenbaum

*Attorney, Agent, or Firm*—Joseph S. Tripoli; George E. Haas; William Squire

[57] ABSTRACT

A coaxial connector for alleviating stresses between a coaxial cable and a strip line conductor includes a center conductor and a stranded wire bundle secured to the center conductor. The bundle projects from the connector body and includes a conductor element for connection to a plane conductor on the strip line circuit. The stranded bundle is sufficiently flexible in the radial direction to permit radial deflection of the end secured to the strip line with respect to the end secured to the connector center conductor position without significant bending stresses. Rotational and axial movement can be provided between the stranded bundle and the center conductor of the connector body to further improve stress alleviation between the extended portion and the body.

5 Claims, 3 Drawing Figures

Fig. 1
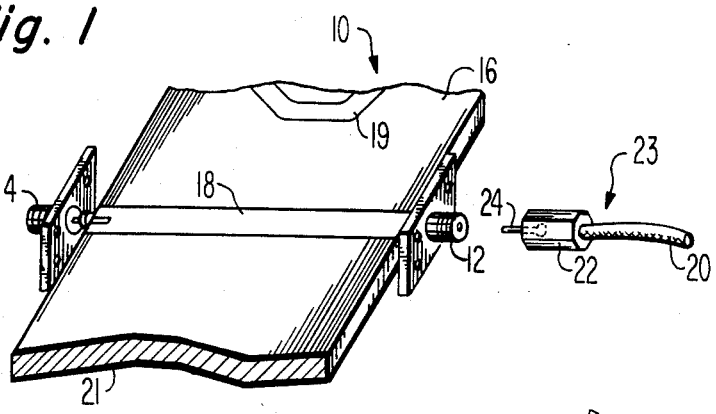
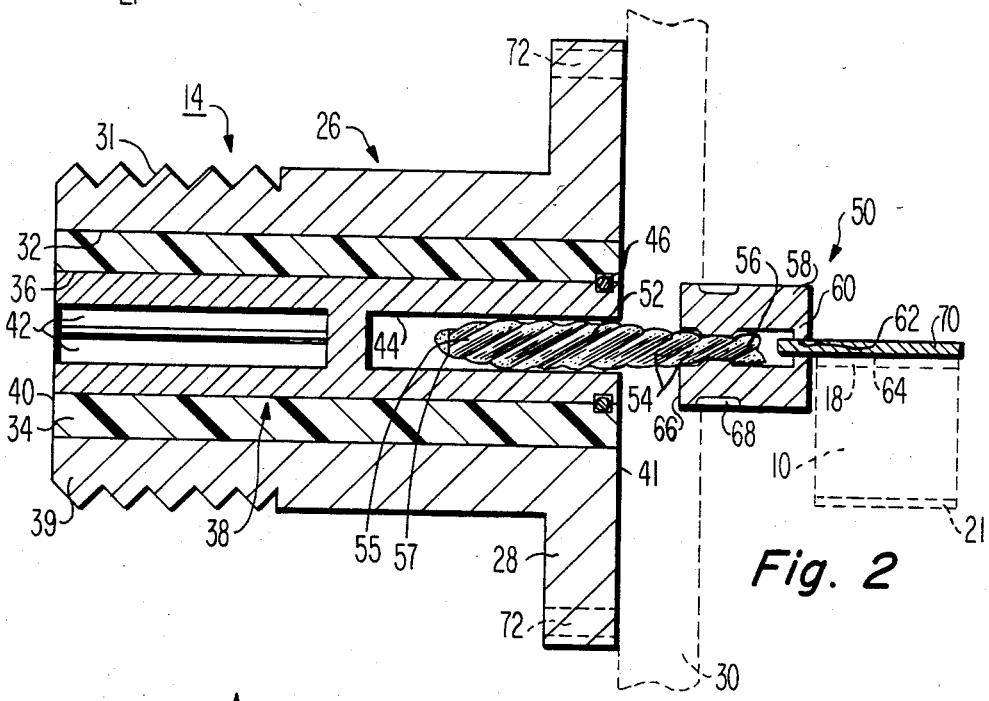
Fig. 2
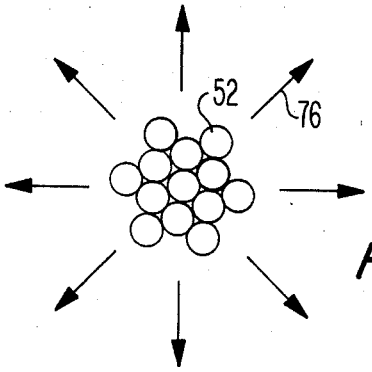
Fig. 3

RF COAXIAL-STRIP LINE CONNECTOR

The present invention relates to an electrical connector for coupling a coaxial transmission line to a strip transmission line.

Planar electrical circuits known as strip lines are widely employed for conducting radio-frequency (RF) signals such as those in the microwave range. Such circuits include flat strip conductors formed on a substrate. In one type of strip line, a relatively narrow center conductor is located on one side of a dielectric sheet and a relatively wide flat conductor on the opposite side of the sheet. A coaxial transmission line may be connected to this type of strip line by employing a coaxial connector. The center conductor of the coaxial connector, which may be one of many known types, projects beyond the connector body and may be connected to the strip line center conductor by placing it over the strip line center conductor and soldering the two together.

To couple the strip line to a coaxial transmission line via a connector of the type described usually requires the connector body to be bolted to the strip line chassis or housing to which the strip line circuit is secured. The center conductor of the connector, which is mechanically fixed in place within the connector body, may comprise a flat planar tab element which is connected (usually by solder) to the strip line conductor with minimum electrical loss at the interface between the two electrical conductors. In these type of connectors, the center conductor projection often does not naturally fall into perfect mechanical alignment with the strip line center conductor. Thus a lack of registration is caused by tolerance build-up between the housing and substrate of the strip line conductor. To overcome this problem, the center conductor projection may be urged onto registration with the strip line. This may be accomplished by bending the center conductor projection to make it conform as accurately as possible to the alignment of the strip line conductor. This may introduce bending stresses into the center conductor projection of the coaxial line connector. Thereafter, such stresses may cause failure of the connection (which is usually solder) between the center conductor projection and the strip line conductor.

The presence of these stresses has been recognized in the art and various solutions thereto have been proposed. In U.S. Pat. No. 4,125,308 a transitional RF connector is disclosed in which a conductor pin is held in the connector body and extends to a fixed connection which may be made to a planar conductor and is provided with a joint which permits rotation and axial movement relatively between two parts in the connector while maintaining electrical contact. Another U.S. patent which relates somewhat to this subject matter is U.S. Pat. No. 3,686,624 which discloses another form of coaxial connector. In this latter patent, the projecting center conductor of the connector structure is reinforced by portions of additional projecting segments of the connector.

In accordance with an embodiment of the present invention, a transition device for an RF coaxial connector for interconnecting a connector center conductor which extends in a given direction to a plane conductor in a plane RF circuit comprises an electrically conductive element adapted to be connected to the connector center conductor, the element being flexible in any radial direction normal to the given direction, the element including conductor means secured thereto for electrically connecting the element to the RF circuit conductor.

In the drawing:

FIG. 1 is an isometric view of a strip line electric circuit to which RF coaxial connectors embodying the present invention are attached;

FIG. 2 is a cross-section view of a connector embodying the present invention; and FIG. 3 is an end view of one of the elements of the connector of FIG. 2 illustrating some of the principles of operation of the connector.

In FIG. 1, RF coaxial connectors 12 and 14 are connected to strip line circuit 10. The connectors 12 and 14 are identical and are shown in more detail in FIG. 2 which is discussed shortly. The strip line circuit 10 comprises a dielectric substrate 16 and a signal conductor 18 on one surface thereof. Other conductors such as conductor 19 and a ground plane conductor 21 are included in the circuit 10. Circuit 10 may comprise any number of well-known strip line configurations and further details thereof need not be given herein. A common structure of the strip line circuits is that they include a plane conductor, such as conductor 18, which may be a thin conductor electrodeposited or otherwise formed on the surface of the substrate 16. The conductor 18 alternatively may be formed by etching away a solid conductor connected to the upper surface of substrate 16 or by other well-known techniques.

The various conductors 18, 19, and so on of circuit 10 sometimes have to be connected to other electrical components by a coaxial cable such as cable 23. Such connection may be accomplished by the male and female mating connectors 22 and 12, respectively. Cable 20 and connector 22 are conventional. The connector 22 has a center conductor pin 24 which is adapted to mate with the center conductor of the connector 12. The connection of 14 to strip line conductor 18 is similar to that of 12 to 18 and described in further detail below in connection with FIG. 2. The connection of 14 to a cable (not shown) corresponding to 23 is similar to that of 12 to 23.

Referring to FIG. 2, connector 14 embodying the present invention, includes a metal housing 26 having a flange 28 for securing the housing to a chassis 30 (shown dashed). Chassis 30 also secures the circuit 10 (dashed line) in a well-known manner. The housing 26 includes a body 39 threaded at 31 which mates with the internal threads in the mating cable connector, such as 22 of FIG. 1. Extending through the housing 26 is a longitudinal bore 32. Secured within the longitudinal bore 32 is a dielectric tube 34. Tube 34 extends from end 40 to end 41 of housing 26 and may be flush at these ends. Tube 34 has a longitudinal bore 36 concentric with bore 32. Secured within bore 36 is center conductor element 38. Element 38 has an elongated circular rod-like structure. End 40 of element 38 is formed into a plurality of longitudinally extending fingers 42 for resiliently gripping a male conductor member inserted therein such as pin 24 of the coaxial cable connector 22, FIG. 1. The construction of the fingers 42 for receiving such a center conductor is well known and widely employed in other RF connector constructions. End 40 is interconnected with the coaxial cable 20, connector 22 by frictionally engaging the pin 24 within the bore framed by fingers 42. The bores 32 and 36 are circular in section. Element 38 is a continuous integral member which is flush at ends 40 and 41. Element 38 at end 41 has a circular bore 44 located centrally therein. A fastening device 46, as known in the art, secures the conductor 38 to the tube 34. Device 46 may comprise a relatively stiff circular wire located within circular grooves formed in the tube 34 and element 38.

A flexible center conductor transition device 50 interconnects element 38 to the strip line conductor 18, FIG. 1. The transition device relieves axial and radial stresses which may exist between it and the center conductor 18 of the strip line circuit 10 as will become more apparent. The transition device 50 comprises a wire strand bundle 52 which includes a plurality of helically wound strands 54. The individual strands 54 are joined together at end 55 by weld 57 and end 56 by sleeve 58 to form an integral stranded structure. The bundle 52 may be formed of conventional commercially available copper alloy stranded wires commonly employed in various electric circuits. The bundle may comprise, for example, 7 strands of 4 mil diameter and 3 strands of 3 mil diameter wire. The bundle 52, FIG. 3, in section has a generally circular periphery and is in sliding frictional engagement with bore 44.

The bundle 52 has a bell shaped periphery, circular in section, tapering from a relatively larger diameter at its mid-section to a narrower diameter at each of the ends. The wire strands are wrapped to form a hollow core at the mid-section. The mid-section is thus "ballooned" somewhat as compared to the end sections to form the bell shape. The diameter at the ballooned mid-section is greater than the bore 44 diameter creating an interference fit therebetween. When bundle 52 is inserted in bore 44 as shown in FIG. 2, the bundle is squeezed and the ballooned mid-section compressed. The wires are joined only at their ends and thus the individual smaller diameter strands of the bundle tend to flex readily when stressed. Bundle 52 and sleeve 58 are commercially available in modified form as a unit for interconnecting two wires. In that form a sleeve similar to sleeve 58 includes a second portion which is crimped to one of the wires. The bundle 52 mates with a contact sleeve having a portion which is crimped to a second wire thus connecting the two wires.

The bundle in the preferred embodiment is not fastened to the element 38 but rather is free to move both axially and to rotate; however, the fit is fairly tight so that there is good electrical coupling between the bundle and the conductor 38.

Stresses sufficient to overcome the friction forces existing between the bundle 52 and the conductor 38 axially slide the bundle 52 within the bore 44. The long axis of the bundle 52 is generally concentric with its outer peripheral surface and therefore slides in a direction generally parallel to the bundle longitudinal axis. This axis is the center axis for the bores 32 and 36 as well. The bundle 52 extends beyond the end 41 which, as mentioned previously, is a surface at which the tube 34, flange 28, and center conductor 38 may be flush. For example, end 66 of sleeve 58 may be spaced from surface 41, 0.01 to 0.02 inches.

Sleeve 58 is an electrically conducting material, preferably a copper alloy or similar material. Sleeve 58 is closed at one end by wall 60. A horizontal slot 62 is formed in wall 60 and extends in and out of the drawing parallel to the plane surface 64 of conductor 18. The other end 66 of the sleeve is open and receives a portion of the extended tapered end 56 of the bundle 52. The sleeve 58 is securely fastened to bundle 52 by crimp 68. The sleeve 58 may be mechanically and electrically secured to the bundle 52 by other means such as soldering. The tab 70 is located in slot 62. Tab 70 comprises a conductive element, preferably beryllium copper, or similar material, which is rectangular in cross-section having its width extending in and out of the drawing. The width and thickness dimensions of the tab 70 may be of the usual dimensions for similar tabs used in conventional RF connectors wherein such tabs are connected directly to the connector center conductor element equivalent to element 38. For example, tab 70 may be 0.005 inches thick by 0.025 inches wide into the drawing and have a length of 0.200 inches. The difference between the present structure and prior RF connectors is the bundle 52 of stranded wire and the sleeve 58 which interface the center conductor 38 of the connector with the tab 70.

In use, the flange 28 is secured to the chassis 30 by fastening means, usually screws or bolts (not shown), which pass through holes 72. Generally, the securing of the flange 28 to the chassis 30 in prior art structures fixes the mechanical alignment of the projecting center conductor portion with respect to the strip line conductor. Such may result in misalignment of the connector center conductor projection which results in undesirable radial forces in the connector center conductor. Such forces tend to cause eventual failure of the connection between the center conductor projecting portion and the strip line conductor.

In FIG. 3, by radial force is meant forces in the direction of the arrows 76. These forces are normal to the longitudinal axis of the bores 32, 36 and the element 38. In the present structure bending stresses produced by such forces are relieved by the flexible bundle 52. The bundle 52 as shown in FIG. 3 responds to stresses in any radial direction 360° about its longitudinal axis. Because the bundle 52 is frictionally engaged in the bore 44, it is also free to rotate in the bore 44. Therefore, the tab 70 is free to move in any radial direction, such as illustrated in FIG. 3, is free to slide axially (to the left and right in the drawing of FIG. 2), and is free to rotate about the central axis of the bore 44. Therefore, any misalignment which may occur between the tab 70 and the conductor 18 when the connector 14 is secured to the chassis 30 and which tends to cause internal stresses between the tab 70 and the connector housing 26 will be relieved by the flexing, rotation, or axial movement of the bundle 52 with respect to the housing 26.

Ordinarily a tab, such as tab 70, employed for interconnecting the center conductor of a coaxial line connector to a circuit conductor, such as conductor 18, which is relatively wide in a direction in and out of the drawing, is relatively stiff in that direction. The bundle 52 comprising a number of separate strands 54 is of higher flexibility in the radial directions than a solid conductor wire made of the same material of about the same diameter as bundle 52. That is, a solid copper conductor of the same diameter as the stranded bundle 52 is significantly more stiff in the radial directions of FIG. 3. Such a wire is stressed when radially bent.

The depth of penetration of the stranded bundle 52 within the bore 44 should be sufficient to provide good mechanical and electrical connection between the bundle 52 and the conductor 38. Should axial stresses not be a problem, then it will occur that the stranded bundle 52 may be permanently fixed to the conductor 38 such as by soldering or crimping. The stranded bundle 52 permits rotation of the tab 70 with respect to the element 38 and bending of the tab 70 in any direction normal to the longitudinal axis of the bundle 52 as described above in connection with FIG. 3. It will also occur to one of ordinary skill that the end 56 of the bundle 52 can be soldered to form an integral structure and may be flattened by mechanical means to form a tab having a configuration such as tab 70. In this case, the sleeve 58 and the tab 70 may be eliminated from the assembly. It is understood that the tab 70 is provided to insure good ohmic connection to the conductor 18 without significant electrical discontinuity. The frictional fit of the bundle 52 within the bore 44 provides good electrical connection between the bundle 52 and the conductor element 38 permits axial and rotational motion therebetween. Such a fit of the various parts can be determined empirically.

What is claimed is:

1. A coaxial RF connector for connecting a coaxial cable to a plane circuit having a plane conductor, said connector comprising:

a metal housing having a bore extending therethrough in a given direction, said housing including means for securing it in a fixed spaced relation to said plane circuit and to said cable;

a dielectric member within said housing bore having a bore extending therethrough in said given direction;

an electrically conductive interconnect conductor element within said dielectric member bore;

an electrically conductive flexible element which is sufficiently flexible in any radial direction normal to said given direction to so that one portion can move out of alignment with respect to a second portion spaced from the one portion in said given direction and located within said interconnect conductor element without signifcant bending stress within said flexible element, said flexible element being electrically connected to said interconnect conductor element at said second portion; and a conductor electrically conductively coupled to said one portion of the flexible element and adapted for connection to said plane conductor.

2. The connector of claim 1 wherein said conductor element includes stranded wires helically wound into a stranded bundle, said bundle being slideably connected to said interconnect conductor element.

3. The connector of claim 1 wherein said interconnect conductor element has a bore, said flexible element being slideably received within said latter bore in said given direction.

4. The connector of claim 1 wherein said flexible element comprises a stranded bundle of helically wound wires, a sleeve having a bore in which said wires are secured, said flexible element extending from said sleeve at one end of the sleeve, said plane element being secured to said sleeve at the sleeve other end opposite the one end.

5. An RF coaxial connector comprising:

a metal housing;

a dielectric member extending through said housing;

a conductor element secured to said dielectric member and extending through and electrically isolated from the housing by said dielectric member, said element having a bore;

a helically wound stranded wire bundle, said bundle closely fitting at one end in said bore to insure good electrical contact with said conductor element and yet being free to slide in the direction of the bore axis and to rotate, said bundle extending from said bore and housing at one end of the bore, said bundle being sufficiently flexible so that the extended end outside said bore can move generally normal to said axis relative to the portion of the bundle in the bore without significant handling stress in said bundle;

an electrically conductive sleeve secured to the extended end of said bundle; and an interface conductor element secured to said sleeve adapted for connection to a planar conductor.

* * * * *